US005735738A

United States Patent [19]

Kuno et al.

[11] Patent Number: 5,735,738

[45] Date of Patent: Apr. 7, 1998

[54] CONDENSATION PREVENTING VENT STRUCTURE

[75] Inventors: Yukio Kuno; Akira Torimi; Kiyoshi Koga, all of Kasuya-gun; Toshisuke Matsumura; Hiromasa Yokoi, both of Osaka, all of Japan

[73] Assignees: Ok Kizai, Inc., Osaka; Kyoritsu Air Tech Inc., Fukuoka, both of Japan

[21] Appl. No.: 694,464

[22] Filed: Aug. 13, 1996

Related U.S. Application Data

[63] Continuation of Ser. No. 352,852, Dec. 10, 1994, abandoned.

[30] Foreign Application Priority Data

Dec. 15, 1993 [JP] Japan ..... 5-343418

[51] Int. Cl.[6] ..... F24F 13/062

[52] U.S. Cl. ..... 454/296; 454/300

[58] Field of Search ..... 454/296, 299, 454/300, 310, 311

[56] References Cited

U.S. PATENT DOCUMENTS

| | | | |
|---|---|---|---|
| 2,403,291 | 7/1946 | Kurth | 454/311 |
| 2,407,284 | 9/1946 | Kennedy | 454/311 |
| 2,618,215 | 11/1952 | Fitt | 454/310 |
| 4,303,007 | 12/1981 | Riegel et al. | 454/299 |

FOREIGN PATENT DOCUMENTS

| | | | |
|---|---|---|---|
| 127114 | 1/1945 | Australia . | |
| 30194 | 10/1974 | Australia . | |
| 52170 | 2/1976 | Australia . | |
| 72453 | 8/1976 | Australia . | |
| 62422 | 12/1976 | Australia . | |
| 63922 | 6/1977 | Australia . | |
| 86885/91 | 6/1994 | Australia . | |
| 57972/94 | 9/1994 | Australia . | |
| 73314 | 11/1951 | Denmark | 454/310 |
| 1222224 | 8/1966 | Germany | 454/310 |
| 28 33 822 | 9/1979 | Germany . | |
| 37 41 839 | 6/1989 | Germany . | |
| 184013 | 7/1989 | Japan | 454/296 |
| 5-52647 | 7/1993 | Japan . | |
| 2250583 | 10/1992 | United Kingdom . | |

*Primary Examiner*—Harold Joyce

*Attorney, Agent, or Firm*—Burns, Doane, Swecker & Mathis, L.L.P.

[57] ABSTRACT

A condensation preventing vent structure has therein at least one blade including an innermost vent to define a passage for a flow of air. The innermost fin is provided with open upper and lower ends to define therein an inner air flow passage. An air flow damper is provided above or in the innermost fin to restrict the air flow in the central portion of the flow passage.

15 Claims, 5 Drawing Sheets

CONDENSATION PREVENTING VENT STRUCTURE

This application is a continuation of application Ser. No. 08/352,852, filed Dec. 2, 1994 abandoned.

BACKGROUND OF THE INVENTION

1. Field of the Invention

The present invention relates to a vent structure for an air conditioner, and more precisely, relates to a vent structure able to prevent condensation.

2. Description of the Related Art

In a conventional air conditioning system, an air blowing outlet is provided in a wall or a ceiling of a room in a building, or other structure, to discharge air to thereby to carry out air-conditioning.

In particular, multiple-flow type vents, in which air is radially discharged from the entire periphery thereof, have been widely used as vents attached to the ceiling of a room, etc. In general, the multiple-flow type vent (anemo type vent) is in the form of a hollow and substantially frusto-conical vent frame which is provided therein with a plurality of fins arranged concentrically with the vent frame.

FIG. 10 shows an example of a known vent 50 which is attached to an opening 100 formed in the ceiling 101 and, through a neck 51, to a duct connecting port 53, so that the vent faces downward. The vent 50 is provided with a hollow and substantially truncated-cone-shaped vent frame (casing) 55 in which a plurality of concentric conical fins 57 are supported, so that air can be discharged in the radial direction from the outlet.

However, the innermost (or central) conical fin 57*a* is provided with a closed top end. Consequently, there is no air flow within the innermost fin. Therefore, when the air-conditioning air is radially discharged from the air passages defined between the adjacent conical fins 57, the hot air in the room, drawn into the vicinity of the innermost fin 57*a* by the flow of cold air discharged from the vent 50 comes into contact with the cold air, resulting in the formation of condensation on the inner surface of the innermost fin 57*a*, due to the difference between the temperatures of the hot air and of the cold air. The condensation not only causes the vent to rust, but also deteriorates the appearance of the vent.

To prevent this, it has been proposed to provide an innermost fin 57A having an open upper end 57B, as shown in FIG. 9 and as disclosed, for example, in Japanese Utility Model Unexamined Publication (Kokai) No. 5-52647. A plate 59 having a number of through holes 61 is provided in the innermost fin 57A. In this proposal, an air flow is caused within the innermost fin 57A to prevent the occurrence of condensation.

Nevertheless, in the arrangement shown in FIG. 9, particularly on the downstream side of the plate 59, the air flow at the center of the flow through the innermost fin 57A is faster than the air flow in the vicinity of the inner surface of the fin 57A and, accordingly, a separation of the air flow in the vicinity of the conical inner surface occurs as indicated by the phantom line S. Consequently, there is only a very small air flow in the vicinity of the inner surface of the fin 57A. Consequently, in the arrangement shown in FIG. 9, condensation D is formed on the inner surface of the innermost fin 57A, due to the difference between the temperatures of the hot air and the cold air, as in the arrangement shown in FIG. 9.

SUMMARY OF THE INVENTION

It is a primary object of the present invention to provide an improved condensation-preventing vent structure, of a good aesthetic appearance, for an air-conditioning system, in which condensation is not formed on any of the fins.

To achieve the object mentioned above, according to the present invention, there is provided a condensation-preventing vent structure having therein at least one fin, including an innermost fin, to define a flow passage of air, said innermost fin being provided with open upper and lower ends to define therein a flow passage, and provision being made of an air flow damper, provided on the upstream side of the innermost fin, to reduce the air flow at the central portion of the flow passage.

The air flow damper can be comprised of a perforated damper and the perforated damper can be made of a mesh or perforated plate with a number of holes.

Preferably, the damper is in the form of a paraboloid of revolution whose diameter gradually decreases toward the downstream side of the air flow, or in the form of a cone whose diameter gradually decreases toward the downstream side of the air flow.

The damper can be provided, on the central portion thereof, with a high impedance smooth flow restricting portion and, on the surrounding portion, with a low impedance smooth flow permitting portion connected to the high impedance portion.

Preferably, the perforated damper has a perforation density distribution in which the perforation density gradually increases from the center portion toward the peripheral portion thereof to gradually reduce the degree of obstruction to the air flow.

It is also possible to provide a restricting plate at the center portion of the flow passage defined within the innermost fin.

According to another aspect of the present invention, a condensation preventing vent structure comprises a plurality of concentric fins including an innermost fin which is provided with open upper and lower ends, air flow passages defined by the adjacent fins, an inner air flow passage defined within the innermost fin, and an air flow damper provided in, or upstream of, the inner air flow passage defined within the innermost fin to locally restrict the air flow at the central portion of the inner flow passage.

In the present invention, as mentioned above, since the innermost fin is provided with open upper and lower ends to define therein the inner air passage and an air flow damper to restrict the air flow at the central portion of the inner air passage, the velocity of the air flow in the central area of the inner flow passage is lower than the velocity of the air flow in the surrounding area and along the inner surface (guide surface) of the innermost fin. Consequently, no separation of the air flow in the vicinity of the inner surface of the innermost fin occurs. Namely, there is sufficient air flow in the vicinity of, or along the inner surface of, the innermost fin. Furthermore, there is also a slight or weak air flow in the central area of the inner air passage. Consequently, no hot air from the room is drawn into the central area due to the absence of an air flow in the central area, and thus, no condensation is formed on the inner surface of the innermost fin.

BRIEF DESCRIPTION OF THE DRAWINGS

The invention will be described below in detail with reference to the accompanying drawings, in which.

DESCRIPTION OF THE PREFERRED EMBODIMENT

Figure 1:
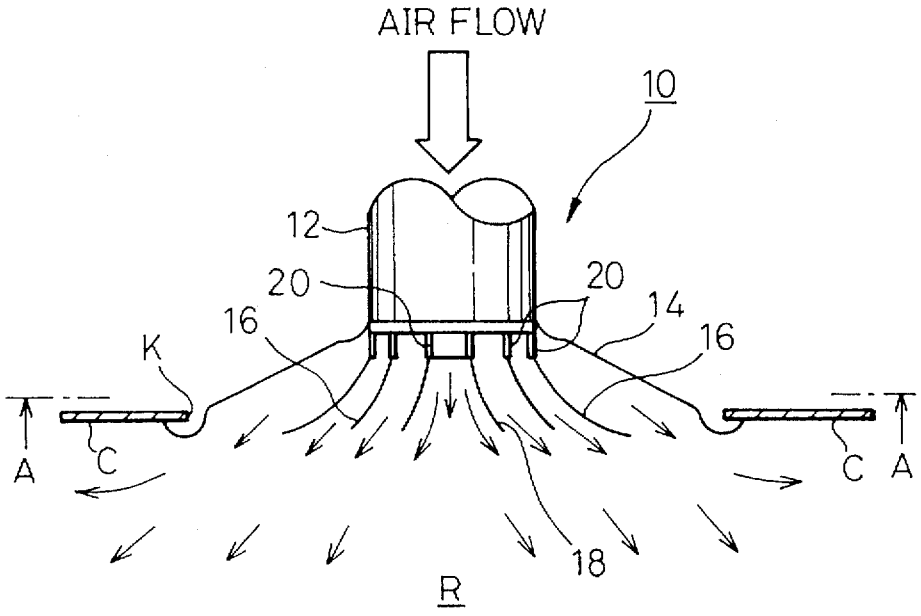
FIG. 1 is a schematic view of a condensation preventing vent structure according to the present invention.

FIG. 1 shows an embodiment of a condensation-preventing-vent structure (referred to as a vent) 10 according to the present invention. The vent 10 is attached to an opening K formed in a ceiling C within a room R with the air discharging end facing the inside of the room R, so that the vent 10 is located behind the ceiling C as viewed from the inside of the room R.

Figure 2:
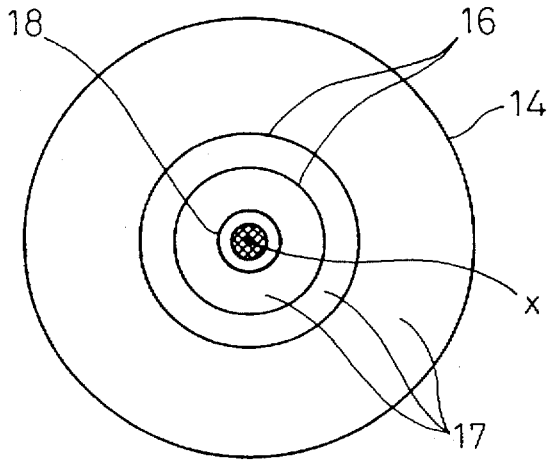
FIG. 2 is a schematic end view taken along the line A—A in FIG. 1, in which a perforated damper is emphasized.

In the illustrated embodiment, the vent 10 is in the form of truncated cone and is made of metal, a light alloy or a synthetic resin. The vent 10 is comprised of an upper hollow neck 12 and a hollow conical vent frame 14 connected thereto. There are a plurality of similar small fins 16, in a concentrical arrangement with respect to the center axis x of the vent frame 14, within the vent frame 14, as can be seen in FIG. 2. In the illustrated embodiment, the vent 10 is circular, and accordingly, the fins 16 constitute a multilayered cone structure.

The fins 16 are spaced from one another to define therebetween annular air passages 17, so that air can be radially discharged from the air passages 17 into the room R. There is an innermost fin (i.e., the central fin) 18 at the center of the vent 10. The fins 16 including the innermost fin 18 are connected and secured to the inner surface of the neck 12 through respective mounting members 20 in the form of annular discs of different diameters.

Figure 3:
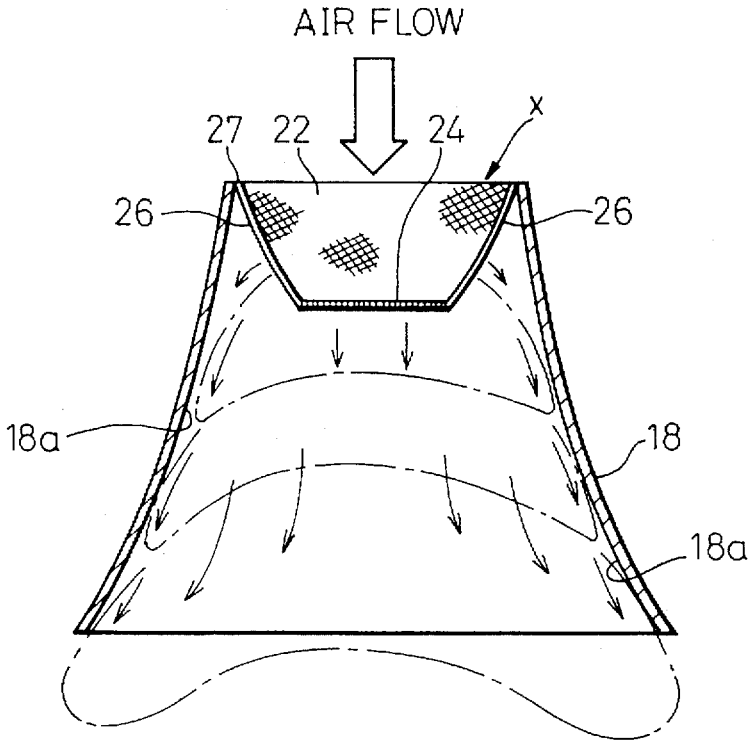
FIG. 3 is a longitudinal sectional view of an innermost conical fin of a condensation preventing vent structure according to the present invention.
Figure 4:
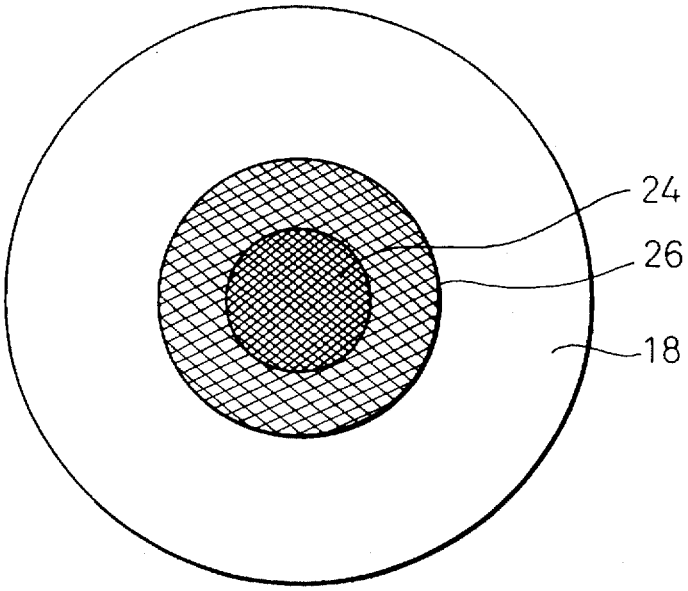
FIG. 4 is a plan view of FIG. 3.

FIGS. 3 and 4 show the innermost blade 18 in the first embodiment of the present invention shown in FIGS. 1 and 2. The innermost fin 18 has open upper and lower ends which permit air to flow therethrough. The innermost fin 18 is provided therein with a perforated damper 22, located at the upstream side thereof, i.e., mounted at the upper end thereof in the illustrated embodiment. The perforated damper 22 constitutes an air flow damping means for damping or decelerating the air flow. The damper 22 is very simple in structure and can be extremely easily mounted onto the innermost fin 18.

The air flow damping means damps or decelerates the air flow particularly at the central portion of the flow passage within the innermost fin 18, that is, it resists or bars the flow at the central portion of the flow passage. Consequently, the flow at the central portion of the flow passage is less rapid than the flow along or in the vicinity of the inner conical surface 18*a* of the innermost fin 18.

As may be seen in FIG. 3, the damper 22 is made of a generally inexpensive mesh in the form of a bowl or paraboloid of revolution, having a diameter gradually decreasing toward the lower end thereof, i.e. toward the downstream side of the air flow.

In the illustrated embodiment, the damper 22 has a flat bottom 24 at the lower end (i.e., downstream side end) thereof and is secured at the upper end 27 (i.e., upstream side end) thereof, to the inner wall surface (guide surface) 18*a* of the innermost fin 18. A paraboloid surface 26 extends between the flat bottom 24 and the upper end 27. The flat bottom 24 has a lower perforation density than that of the side peripheral surface (i.e., the paraboloid surface) 26. Namely, the mesh of the flat bottom 24 is more dense than the mesh of the paraboloid surface 26, as can be seen in FIG. 4. Consequently, the flat bottom portion (high impedance portion) 24 restricts the air flow more than the side peripheral portion (low impedance portion) 26 does.

Figure 6:
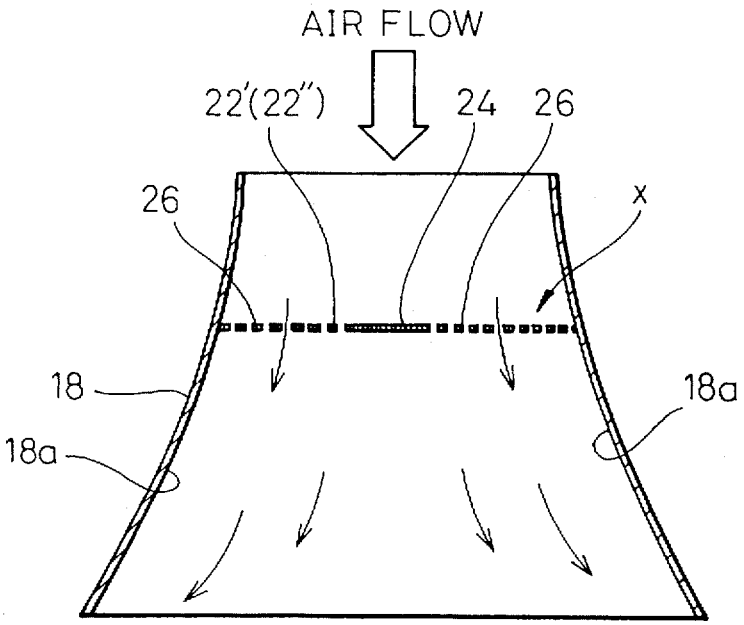
FIG. 6 is a longitudinal sectional view of another embodiment of a flow damper, according to the present invention.

Although the damper 22 is in the form of a paraboloid of revolution in the first embodiment mentioned above, it can be made of, for example a planar mesh 22' as shown in FIG. 6. In this modification, the planar mesh has a non-uniform perforation density distribution (mesh density). That is, the center portion (corresponding to the high impedance portion) of the planar mesh 22' is more dense than the circumferential portion (corresponding to the low impedance portion) thereof. Nevertheless, the embodiment shown in FIGS. 3 and 4 is more preferable than the embodiment shown in FIG. 6 because, in the paraboloid-shaped mesh, a velocity component in a direction normal to the direction of the major flow is generated when the air passes through the mesh of the paraboloid surface 26 (FIGS. 3 and 4). This velocity component of the air flow causes an air flow along the inner surface 18*a* of the innermost fin 18. Consequently, it is ensured that there is a sufficient amount of air flow in the vicinity of, or along the inner surface 18*a* of, the innermost fin 18, unlike the prior art in which a separation of the air flow from the inner surface tends to occur, thus resulting in little or no air flow along, or in the vicinity of, the inner surface of the innermost fin, leading to the formation of the condensation, as mentioned above.

Although the planar mesh 22' includes the high impedance portion 24 at the center thereof and the low impedance portion 26 surrounding the same in FIG. 6, it is possible to provide a planar mesh having a perforation density distribution which gradually and continuously increases from the center to the periphery thereof, to thereby gradually reduce the degree of obstruction to the air flow toward the peripheral portion of the planar mesh 22'.

The planar mesh 22' can be replaced with a metal or plastic plate 22" which is provided with a large number of perforations punched therein. In case of a plastic molded plate, the perforations can be integrally formed during molding.

Figure 5:
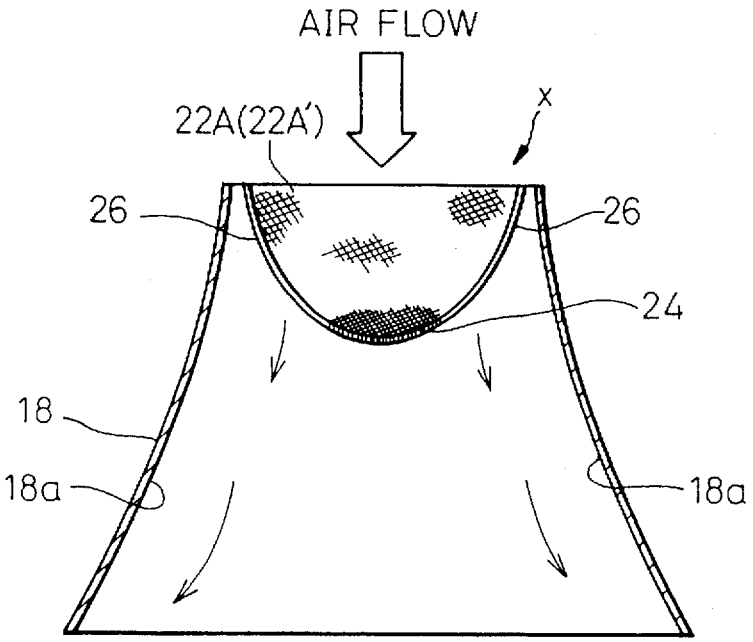
FIG. 5 is a longitudinal sectional view of the innermost conical fin, with a deflector (flow damper), of a condensation preventing vent structure according to another embodiment of the present invention.

FIG. 5 shows another embodiment of a perforated damper 22A which is made of a mesh in the form of a perfect paraboloid of revolution. The same technical effects as those of the previous embodiments can be expected from the arrangement shown in FIG. 5. The mesh 22A can be also replaced with a plate 22A' having a large number of punched perforations.

Figure 7:
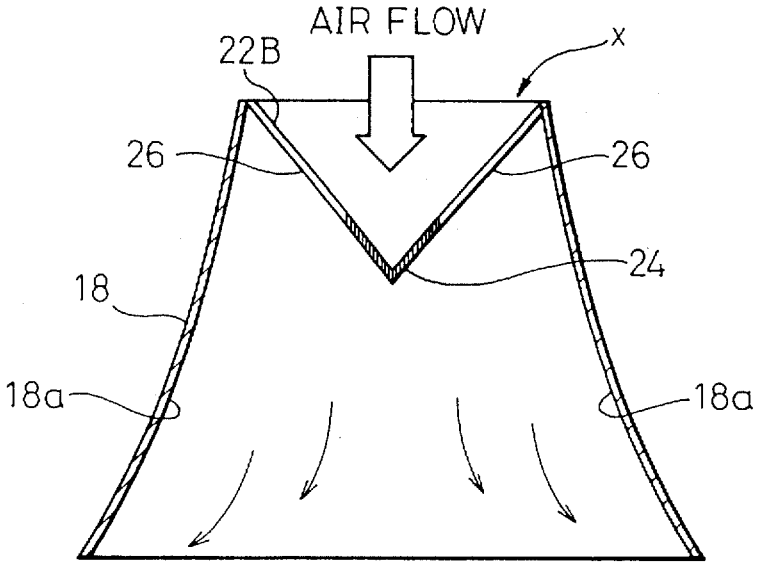
FIG. 7 is a longitudinal sectional view of yet another embodiment of a damper, according to the present invention.

FIG. 7 shows another embodiment of an air flow damping means provided on the innermost fin 18 of the vent 10 according to the present invention. In the embodiment shown in FIG. 7, the perforated damper 22B is made of a mesh or a perforated plate with punched perforations in the form of a cone whose apex faces downward. Namely, the base portion of the cone having the largest diameter is secured to the inner surface 18*a* of the innermost fin 18 at the top end thereof.

In this embodiment, a velocity component of the air flow in the direction toward the inner surface 18*a* of the innermost fin 18 is generated when the air is discharged from the mesh or perforations of the cone in the downstream direction, similar to the above-mentioned embodiment. This velocity component of the air flow causes an air flow along the inner surface 18*a* of the innermost fin 18. Consequently, there is sufficient air flow in the vicinity of or along the inner surface 18*a* of, the innermost fin 18.

The perforated damper 22B includes the high impedance portion 24 in the vicinity of the apex of the cone and the low impedance portion 26 on the conical surface other than the high impedance portion 24, similar to the above-mentioned embodiments. Consequently, the air flow at the central portion of the flow passage within the perforated damper 22B is obstructed or decelerated, and the air flow in the vicinity of, or along the inner surface 18*a* of, the innermost fin 18 is faster than the obstructed air flow at the central portion of the flow passage.

As a result, there is an air flow along, or in the vicinity of, the inner conical surface 18*a* of the innermost fin 18. The weak air flow passing through the high impedance portion 24 prevents the hot air in the room R (FIG. 1) from being attracted or drawn into the center portion of the flow passage. Thus, no condensation occurs on the inner surface 18*a* of the innermost fin 18.

Figure 8:
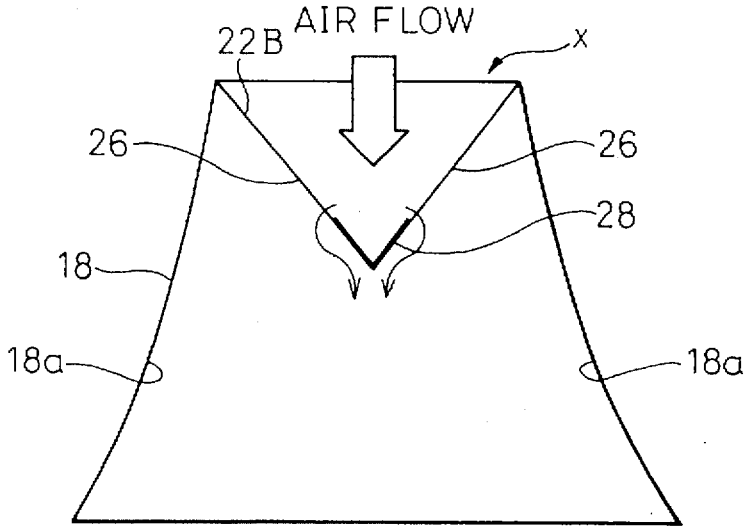
FIG. 8 is a longitudinal sectional view of still another embodiment of a damper, according to the present invention.

FIG. 8 shows a modification of the arrangement shown in FIG. 7. In the arrangement illustrated in FIG. 8, a restricting plate 28 in the form of a small hollow cone is provided at the center portion, i.e., the apex of the cone 22B shown in FIG. 7. The restricting plate 28 closes or interrupts the flow passage only in the vicinity of the apex of the cone, i.e., only a limited area of the flow passage at the center portion thereof. Nevertheless, an air flow component along the restricting plate 28 is produced on the downstream side thereof by the air stream deflected by the restricting plate 28 and flowing toward the downstream side, as indicated by arrows in FIG. 8. Consequently, the hot air in the room R is not attracted into the center portion of the flow passage within the innermost fin 18, thus no condensation occurs on the inner wall surface of the innermost fin.

The restricting plate 28 can be equally applied to any type or shape or material of the perforated damper (22, 22', 22", 22A, 22A', 22B).

It is possible to provide only the restricting plate 28 without the perforated damper in the flow passage of the innermost fin. In this case, the restricting plate 28 can be supported at the center portion of the flow passage within the innermost fin by a mounting arm or rod (not shown), etc. The absence of the perforated damper simplifies the vent structure, reduces the manufacturing cost and the number of manufacturing processes thereof. Moreover, the vents can be cheaply mass-produced.

As mentioned above, in FIG. 1, when cold air is introduced into the vent structure through the neck 12 thereof, the cold air is radially discharged from the concentrical flow passages 17 (FIG. 2) between the adjacent fins 16 including the innermost fin 18. In addition to the air flows from the flow passages 17, the air can be also discharged through the flow passage formed within the innermost fin 18. Within the flow passage in the innermost fin 18, since the air flow at the center portion thereof is obstructed or decelerated by the flow damper in comparison with the surrounding air flow, the latter flows faster than the central air flow. Consequently, no separation of the air flow from the inner wall surface of the innermost fin takes place, that is, there is a sufficient amount of air flow along, or in the vicinity of, the inner wall surface of the innermost fin. Moreover, since there is a weak air flow also in the center portion of the flow passage, there is no attraction of a substantial amount of air, into the center portion of the flow passage, from the surrounding portion at the downstream side of the innermost fin 18. Hence, condensation can be effectively prevented.

It was experimentally confirmed that there was no additional noise produced by the flow damping means and, instead, the noise level was lower than in conventional vent structures.

Figure 9:
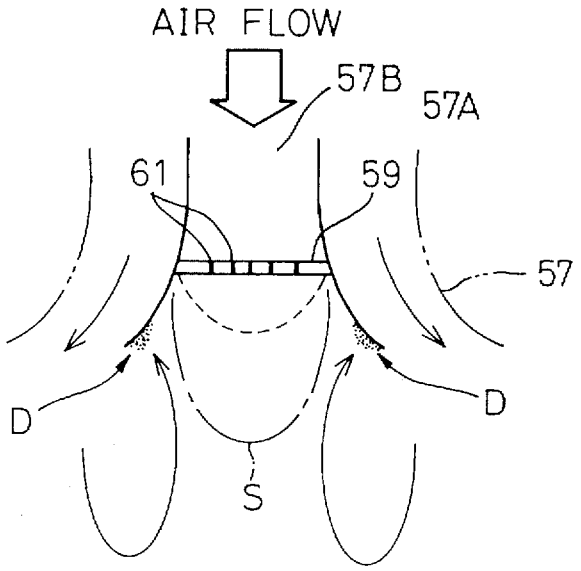
Fig.9 (PRIOR ART)
FIG. 9 is an explanatory view of a known vent structure for an air-conditioning system, to explain an air flow in the vicinity of an innermost conical fin; and, FIG. 10 is an explanatory view of another known vent structure for an air-conditioning system.
Figure 10:
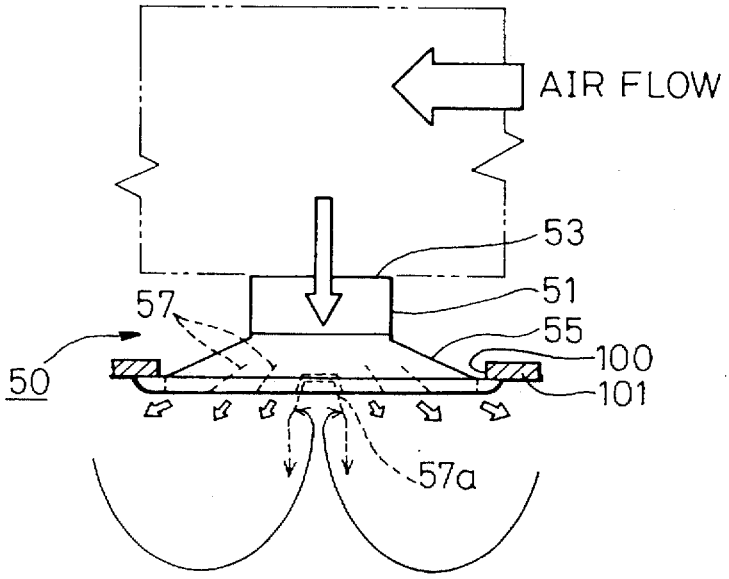
Fig.10 (PRIOR ART)

Furthermore, in the conventional vent structure, as shown in FIG. 9, in which the improvement was directed to the presence of the open upper end (instead of the closed upper end) of the innermost fin so as to form therein a flow passage, the hot air in the room R can be drawn into the air flow and reaches the ceiling, thus resulting in a contamination of the ceiling. Contrary to this, in the present invention, since no or little separation of the air flow occurs the ceiling is not stained.

Although the above discussion has been directed to an air vent having a plurality of concentrical fins, the present invention is not limited thereto. For example, the condensation preventing vent structure of the present invention can be applied to a vent having therein a single fin which can be considered to be equivalent to the innermost fin discussed above. Moreover, the shape of the vent is not limited to a circle as in the illustrated embodiments, and can be any shape including an angular shape.

The present invention is not limited to the illustrated embodiments and can be modified without departing from the scope of the invention claimed in the claims.

For instance, the air flow damping means which is provided at the upper end of the innermost fin in the illustrated embodiments can be provided above the upper end of the innermost fin or even at a position further downstream than the arrangement shown in the drawings, as long as the air flow separation preventing effect can be retained.

As can be understood from the above discussion, according to the present invention, since the innermost fin is provided with open upper and lower ends to define therein an inner air flow passage, and the air flow damper is provided on the upstream side of the innermost fin to damp the air flow at the central portion of the inner air flow passage, the velocity of the air flow in the central area of the inner flow passage is relatively less than that of the air flow in the vicinity of, or along the inner surface of, the innermost fin. Therefore, no separation of the air flow in the vicinity of the inner surface of the innermost fin occurs, that is, there is a sufficient amount of air flow in the vicinity of, or along the inner surface of, the innermost fin. In addition, since there is a weak air flow in the central area of the inner air flow passage, the hot air in the room is not drawn into the air flow due to an absence of an air flow in the central area. Thus, no condensation is formed on the inner surface of the innermost fin.

The air flow damper can be easily realized by a perforated damper which can be easily and inexpensively made of a mesh or a perforated plate with a number or holes.

If the perforated damper is in the form of a paraboloid of revolution whose diameter gradually decreases toward the downstream side of the air flow, or in the form of a cone whose diameter gradually decreases toward the downstream side of the air flow, an air flow component toward the inner wall surface of the innermost fin can be easily and certainly produced.

If the perforated damper is provided, on the central portion thereof, with a high impedance flow obstructing portion and, on the surrounding portion of the high impedance portion, with a low impedance smooth flow permitting portion connected to the high impedance portion, the flow restriction effect, particularly at the central portion of the inner flow passage, can be enhanced.

The same is true when the perforated damper has a perforation density distribution in which the perforation density gradually increases from the center portion toward the peripheral portion thereof to gradually reduce the degree of obstruction to the air flow.

If the air flow damper is comprised of a restricting plate provided at the center portion of the flow passage defined within the innermost fin the air flow damper can be simplified and easily and inexpensively produced.

We claim:

1. A condensation preventing vent structure having therein at least one fin to define an air-flow passage, said fin being provided with open upper and lower ends to define therein a flow passage, and an air flow damper provided on an upstream side of said fin to damp air flow at a central portion of the flow passage, wherein the air flow damper is provided at a central portion of the damper with a high impedance flow restricting portion, and on a surrounding portion of the damper with a low impedance smooth air flow permitting portion connected to the high impedance flow restricting portion.

2. A condensation preventing vent structure according to claim 1, wherein said air flow damper is comprised of a perforated damper.

3. A condensation preventing vent structure according to claim 2, wherein said perforated damper is made of a perforated plate with a number of perforations.

4. A condensation preventing vent structure having therein at least one fin to define an air-flow passage, said fin being provided with open upper and lower ends to define therein a flow passage, and an air flow damper provided on an upstream side of the fin to damp air flow at a central portion of the flow passage, wherein the air flow damper is provided at a central portion of the damper with a high impedance flow restricting portion, and on a surrounding portion of the damper, with a low impedance smooth air flow permitting portion connected to the high impedance flow restricting portion, said air flow damper being comprised of a perforated damper, and said perforated damper being made of a mesh.

5. A condensation preventing vent structure having therein at least one fin to define an air-flow passage, said fin being provided with open upper and lower ends to define therein a flow passage, and an air flow damper provided on an upstream side of the fin to damp air flow at a central portion of the flow passage, wherein the air flow damper is provided at a central portion of the damper with a high impedance flow restricting portion, and on a surrounding portion of the damper, with a low impedance smooth air flow permitting portion connected to the high impedance flow restricting portion, said air flow damper being comprised of a perforated damper, and said perforated damper being in the form of a paraboloid of revolution whose diameter gradually decreases toward the downstream side of the air flow.

6. A condensation preventing vent structure having therein at least one fin to define an air-flow passage, said fin being provided with open upper and lower ends to define therein a flow passage, and an air flow damper provided on an upstream side of the fin to damp air flow at a central portion of the flow passage, wherein the air flow damper is provided at a central portion of the damper with a high impedance flow restricting portion, and on a surrounding portion of the damper, with a low impedance smooth air flow permitting portion connected to the high impedance flow restricting portion, said air flow damper being comprised of a perforated damper, and said perforated damper being in the form of a cone whose diameter gradually decreases toward the downstream side of the air flow.

7. A condensation preventing vent structure having therein at least one fin to define an air-flow passage, said fin being provided with open upper and lower ends to define therein a flow passage, and an air flow damper provided on an upstream side of the fin to damp air flow at a central portion of the flow passage, wherein the air flow damper is provided at a central portion of the damper with a high impedance flow restricting portion, and on a surrounding portion of the damper, with a low impedance smooth air flow permitting portion connected to the high impedance flow restricting portion, said air flow damper being comprised of a perforated damper, and said perforated damper being a perforation density distribution in which the perforation density gradually increases from the center portion toward the peripheral portion thereof to gradually reduce the degree of obstruction to the air flow.

8. A condensation preventing vent structure according to claim 1, wherein said air flow damper comprises a restricting plate provided at the center portion of the flow passage defined within said fin.

9. A condensation preventing vent structure according to claim 1, wherein said air flow damper possesses a diameter that gradually decreases toward the downstream side of the air flow, the air flow damper extending into the air flow passage so that at least a portion of the air flow damper is located between the upper and lower ends of said fin.

10. A condensation preventing vent structure comprising a plurality of concentric fins including an innermost fin which is provided with open upper and lower ends, air flow passages defined by and between adjacent fins, an inner air flow passage defined within the innermost fin, and a perforated, air flow damper provided in or upstream of the inner air flow passage defined within the innermost fin to locally restrict the air flow at the central portion of the inner flow passage more than the air flow at the outer portion of the inner flow passage, the air flow damper extending solely across the innermost fin, said air flow damper is made of a predetermined mesh shape whose perforation density distribution is not uniform.

11. A condensation preventing vent structure according to claim 10, wherein said air flow damper is provided, at the central portion of the damper with a high impedance flow restricting portion, and on the surrounding portion of the damper with a low impedance smooth air flow permitting portion connected to the high impedance flow restricting portion.

12. A condensation preventing vent structure according to claim 10, wherein said air flow damper possesses a diameter that gradually decreases toward the downstream side of the air flow, the air flow damper extending into the air flow passage so that at least a portion of the air flow damper is located between the upper and lower ends of the innermost fin.

13. A condensation preventing vent structure, comprising a hollow vent frame having a center axis, a plurality of fins arranged within the vent frame around the center axis to define air passages between adjacent fins, said plurality of fins including an innermost fin having an open upper end and an open lower end between which is defined a flow passage, the lower end being located downstream of the upper end, and air flow damping means for damping air flow in at least a central portion of the flow passage and said damping means having means for producing an air flow in the central portion of the flow passage which is less rapid than air flow along an inner surface of the innermost fin, at least a portion of the damping means being positioned downstream of the open upper end of the innermost fin.

14. A condensation preventing vent structure according to claim 13, wherein said damping means is mounted at the upper end of the innermost fin and extends in the downstream direction within the innermost fin.

15. A condensation preventing vent structure according to claim 13, wherein said damping means includes a generally planar member positioned within the innermost fin intermediate the upper and lower ends.

* * * * *